US006753846B2

(12) United States Patent
Takeuchi et al.

(10) Patent No.: US 6,753,846 B2
(45) Date of Patent: Jun. 22, 2004

(54) REFLECTIVE DISPLAY DEVICE

(75) Inventors: Yukihisa Takeuchi, Nishikamo-Gun (JP); Tsutomu Nanataki, Toyoake (JP); Natsumi Shimogawa, Nagoya (JP); Takayoshi Akao, Kasugai (JP)

(73) Assignee: NGK Insulators, Ltd., Nagoya (JP)

( * ) Notice: Subject to any disclaimer, the term of this patent is extended or adjusted under 35 U.S.C. 154(b) by 252 days.

(21) Appl. No.: 10/029,362

(22) Filed: Dec. 21, 2001

(65) Prior Publication Data

US 2002/0080129 A1 Jun. 27, 2002

(30) Foreign Application Priority Data

Dec. 27, 2000 (JP) ..... 2000-399508
Sep. 18, 2001 (JP) ..... 2001-284040

(51) Int. Cl.[7] ..... G09G 3/34
(52) U.S. Cl. ..... 345/108; 359/290; 385/901
(58) Field of Search ..... 345/102, 105, 345/204, 30, 108; 349/61–63; 385/901; 359/290–293

(56) References Cited

FOREIGN PATENT DOCUMENTS

EP 0 675 477 A1 10/1995
EP 0 967 507 A1 12/1999
JP 7-287176 10/1995

OTHER PUBLICATIONS

U.S. patent application Ser. No. 09/341,151, Akao et al., filed Jul. 1, 1999.

*Primary Examiner*—Regina Liang
(74) *Attorney, Agent, or Firm*—Burr & Brown

(57) ABSTRACT

A reflective display device includes a transparent display panel into which light is introduced. A driving section is disposed at the back of the display panel. Actuator elements corresponding to a number of picture elements are arranged in the driving section. A picture element assembly is provided on each of the actuator elements. The picture element assembly includes a light-reflecting layer and a color filter. A light-absorptive material is filled between the display panel and an actuator substrate. The actuator elements are selectively driven according to an attribute of an input image signal for controlling displacement of the picture element assembly in a direction closer to or away from the display panel, thereby adjusting degree of light-absorption and/or light reflection between the display panel and the picture element assembly so that a screen image corresponding to the image signal is displayed on the display panel.

6 Claims, 16 Drawing Sheets

REFLECTIVE DISPLAY DEVICE

BACKGROUND OF THE INVENTION

1. Field of the Invention

The present invention relates to a reflective display device for displaying a screen image corresponding to an input image signal on a display panel by selectively driving an actuator element depending upon an attribute of the image signal.

2. Description of the Related Art

Cathode ray tubes (CRT), liquid crystal display devices or the like have been known as the display device.

Usual television receivers, monitors for computers or the like have also been known as the cathode ray tube. Although the cathode ray tube has a bright screen, it consumes a large amount of electric power. In the cathode ray tube, further, the depth of the display device is large as compared with the size of the screen.

In comparison with the cathode ray tube, the liquid crystal display device is small, and consumes a small amount of electric power. However, brightness of the liquid crystal display device is not good. Further, viewing angle of the crystal display device is not wide.

To display a color image on the screen in the cathode ray tube and the liquid crystal display device, it is necessary to use many picture elements (image pixels), which is three times as many as the picture elements of a black-and-white screen. Therefore, the device itself is complicated, a large amount of electric power is consumed, and thus, the cost is relatively high.

As a solution of the above problems, the applicant has proposed a novel display device (see, for example, Japanese Laid-Open Patent Publication No. 7-287176). As shown in FIG. 16, this display device includes actuator elements 400 arranged for respective picture elements. Each of the actuator elements 400 comprises a main actuator element 408 including a piezoelectric/electrostrictive layer 402 and an upper electrode 404 and a lower electrode 406 formed on upper and lower surfaces of the piezoelectric/electrostrictive layer 402 respectively, and an actuator substrate 414 including a vibrating section 410 and a fixed section 412 disposed under the main actuator element 408. The lower electrode 406 of the main actuator element 408 contacts the vibrating section 410. The main actuator element 408 is supported by the vibrating section 410.

The actuator substrate 414 is composed of ceramics in which the vibrating section 410 and the fixed section 412 are integrated into one unit. A recess 416 is formed in the actuator substrate 414 so that the vibrating section 410 is thin-walled.

A displacement-transmitting section 420 for obtaining a predetermined contact area with an optical waveguide plate 418 is connected to the upper electrode 404 of the main actuator element 408. In the illustrative display device shown in FIG. 16, the displacement-transmitting section 420 is located near the optical waveguide plate 418 in the OFF selection state or the unselection state in which the actuator element 400 stands still, while it contacts the optical waveguide plate 418 in the ON selection state at a distance of not more than the wavelength of the light.

The light 422 is introduced, for example, from a lateral end of the optical waveguide plate 418. In this arrangement, all of the light 422 is totally reflected in the optical waveguide plate 418 without being transmitted through front and back surfaces thereof by controlling the magnitude of the refractive index of the optical waveguide plate 418. In this state, a voltage signal corresponding to an attribute of an image signal is selectively applied to the actuator element 400 by the upper electrode 404 and the lower electrode 406 so that the actuator element 400 may make a variety of displacement actions in conformity with the ON selection, the OFF selection, and the unselection. Thus, the displacement-transmitting section 420 is controlled for its contact with and separation from the optical waveguide plate 418. Accordingly, the scattered light (leakage light) 424 is controlled at a predetermined portion of the optical waveguide plate 418, and a screen image corresponding to the image signal is displayed on the optical waveguide plate 418.

When a color image is displayed using the display device, light sources for the three primary colors are switched to control the light emission time for the three primary colors, while synchronizing the contact time between the optical waveguide plate and the displacement-transmitting plate with the cycle of color development. Alternatively, the contact time between the optical waveguide plate and the displacement-transmitting plate is controlled, while synchronizing the light emission time for the three primary colors with the color development cycle.

Therefore, in the display device proposed by the present applicant, it is unnecessary to use many picture elements, even if the display device is use to display the color image.

SUMMARY OF THE INVENTION

An object of the present invention is to improve the display device proposed by the present applicant and provide a reflective display device which makes it possible to simplify the arrangement for introducing the external light and/or the light from a light source, improve the luminance or brightness, improve the contrast, and improve the quality of a displayed image.

According to the present invention, a reflective display device comprises:

a display panel into which light is introduced;

a driving section disposed at the back of the display panel, the driving section including a plurality of actuator elements corresponding to a number of picture elements;

a picture element assembly provided on each of the actuator elements, the picture element assembly including at least a light-reflecting section and/or a light-absorbing section; and a light-absorptive and/or a light-reflective substance filled between the display panel and the driving section, wherein the actuator elements are selectively driven according to an attribute of an input image signal for controlling displacement of the picture element assembly in a direction closer to or away from the display panel, thereby adjusting degree of light-absorption and/or light reflection between the display panel and the picture element assembly so that a screen image corresponding to the image signal is displayed on the display panel. Preferably, the display panel is transparent.

Accordingly, the light from the external light or the light source is simply radiated onto the display panel, without introducing the external light or the light from the light source so that the light is totally reflected in the display panel. Therefore, it is possible to greatly simplify the arrangement for introducing the external light or the light from the light source.

Light emission is effected when a thickness of the light-absorptive substance between the display panel and the picture element assembly is decreased by displacing the picture element assembly in the direction closer to the display panel. Light emission is stopped when the thickness of the light-absorptive substance between the display panel and the picture element assembly is increased by displacing the picture element assembly in the direction away from the display panel.

Alternatively, light emission is stopped when a thickness of the light-reflective substance between the display panel and the picture element assembly is decreased by displacing the picture element assembly in the direction closer to the display panel. Light emission is effected when the thickness of the light-reflective substance between the display panel and the picture element assembly is increased by displacing the picture element assembly in the direction away from the display panel.

The picture element assembly may have a color layer. In this arrangement, the light-reflecting section and/or the light-absorbing section of the picture element assembly may serve as the color layer.

Further, for example, a three primary color filter, a complementary color filter, or a color scattering element may be used as the color layer. The "color scattering element" herein refers to an opaque one which is obtained, for example, by dispersing a dyestuff such as a pigment in a resin or the like.

In this case, the light-absorptive substance (light-absorptive material) is not limited to black one. For example, a blue light-absorptive material may be used. In this case, for example, when it is assumed to use no color filter, it is possible to display white dots on a blue background. Further, when a red color filter is used in combination, it is possible to display red dots on a blue background.

As described above, it is possible to select arbitrary background colors and display colors by combining colors of the color filter and the light-absorptive material. Similarly, when the light-absorbing section is formed for the picture element assembly, for example, a black color can be displayed on a blue background.

As the light-absorptive material, it is possible to use a liquid, an emulsion, and a gel dispersed with a pigment or a dye, and a flexible resin material and a combination thereof. A sponge or the like impregnated with the liquid can also be used.

It is possible to use the liquid obtained by dispersing a pigment in water, oil, or organic solvent having a low vapor pressure, and a colored dye. For example, it is possible to use one obtained by dispersing carbon black in silicone oil having high electric insulation. It is preferable to select, as the silicone oil, an oil having a low viscosity in order to quickly switch the image display. The carbon black is more preferably used if it is applied with a surface coating in order to enhance the electric insulation.

As the light-reflective substance (light-reflective material), it is possible to use a liquid, an emulsion, and a gel dispersed with a pigment or a dye, and a flexible resin material and mercury and a combination thereof. A sponge or the like impregnated with the liquid can also be used.

As the method for controlling the light transmittance of the light-absorptive material or the light-reflective material, it is preferable to change the thickness of the light-absorptive material or the light-reflective material (distance between the display panel and the picture element assembly) by the displacement of the actuator element. The thickness or the displacement is, preferably, though not limited to, not less than 0.1 $\mu$m and not more than 10 $\mu$m.

It is also preferable that a concave/convex structure is provided for a portion of the picture element assembly facing the light-absorptive material or the light-reflective material. When the light-absorptive material and/or the light-reflective material is a fluid, the concave/convex structure forms the flow passage. Therefore, the response performance of emitting light and stopping the light emission is improved. A convex form is also preferably used.

It is also preferable to use a transparent layer at a portion of the picture element assembly facing the light-absorptive material or the light-reflective material. The transparent layer adjusts the height of the picture element assembly, for example, so as to obtain a uniform thickness of the light-absorptive material and/or the light-reflective material in the natural state of the actuator element. The concave/convex structure or the convex shape may be formed for the transparent layer.

It is possible to improve the light emission luminance and/or the contrast by radiating the light from the light source onto the display panel, making it possible to enhance the performance of visual recognition. As the gradational expression system, it is preferable to use any one of or a combination of the area gradation, the time gradation, and the voltage gradation.

According to the reflective display device of the present invention, an ultrathin type low electric power-consuming display can be constructed. Therefore, for example, the reflective display device of the present invention is effective for a large screen display constructed by arranging a plurality of display devices of the present invention vertically and laterally respectively. Such a display requires no projection space as compared with a projector, which can be installed even in a narrow space.

In addition to usual oblong displays, it is possible to form screens of various shapes. For example, it is possible to form the laterally longer screen, the vertically longer screen, and the circular screen by arbitrarily changing the number of the arranged display devices of the present invention. If the display devices of the present invention are curved, a curved display can also be formed.

The large screen display is applied to the public, for example, in waiting rooms, lobbies, and corridors of stations, hospitals, airports, libraries, department stores, hotels, and wedding halls, based on the use of the features of the thin type, the large screen, and the wide angle of visibility. Further, the large screen display may be also utilized for screens of cinema complexes, sing-along machine or karaoke boxes, and mini-theaters. The large screen display may be used in both indoor and outdoor conditions.

When the color layer is provided for the picture element assembly, then the color layer may be formed at an upper portion of the light-reflecting section of the picture element assembly, or the color layer may be formed on the front surface or the back surface of the display panel. Specifically, when a large number of reflective display devices of the present invention are arranged for a display panel or a frame (including a lattice frame) having a large size to construct a large screen display, the color layer may be formed on the front surface or the back surface of the large-sized display panel. Alternatively, for example, a plate or a film, which has the color layer, may be provided for the display panel. When the color layer is provided for the display panel, a color filter is preferably used. In this case, as the picture element assembly, it is possible to use any one of the white scattering element, the color scattering element, and the color filter as the color layer. However, it is particularly preferable to use the white scattering element.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

Several illustrative embodiments of the reflective display device according to the present invention will be explained below with reference to FIGS. 1 to 16.

Figure 1:
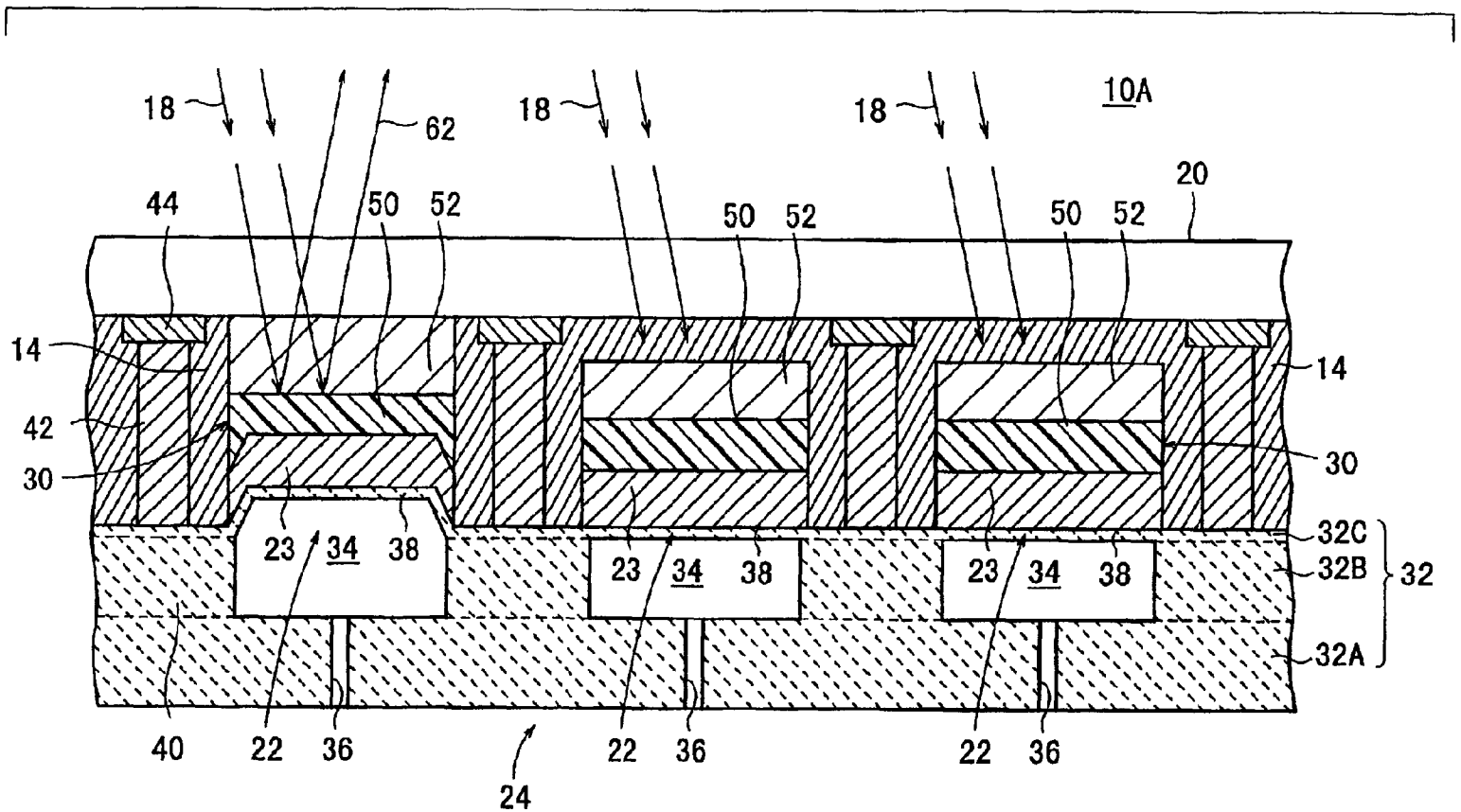
FIG. 1 is a view showing a reflective display device according to a first embodiment.

As shown in FIG. 1, a reflective display device 10A of a first embodiment comprises a display panel 20 which is irradiated with external light, light from an unillustrated light source, or light combining the external light and the light from the unillustrated light source (hereinafter referred to as "light 18"), and a driving section 24 which opposes the back surface of the display panel 20 and which includes a plurality of actuator elements 22. The plurality of actuator elements 22 are arranged in a matrix form or in a zigzag form corresponding to a number of picture elements (image pixels).

Figure 2:
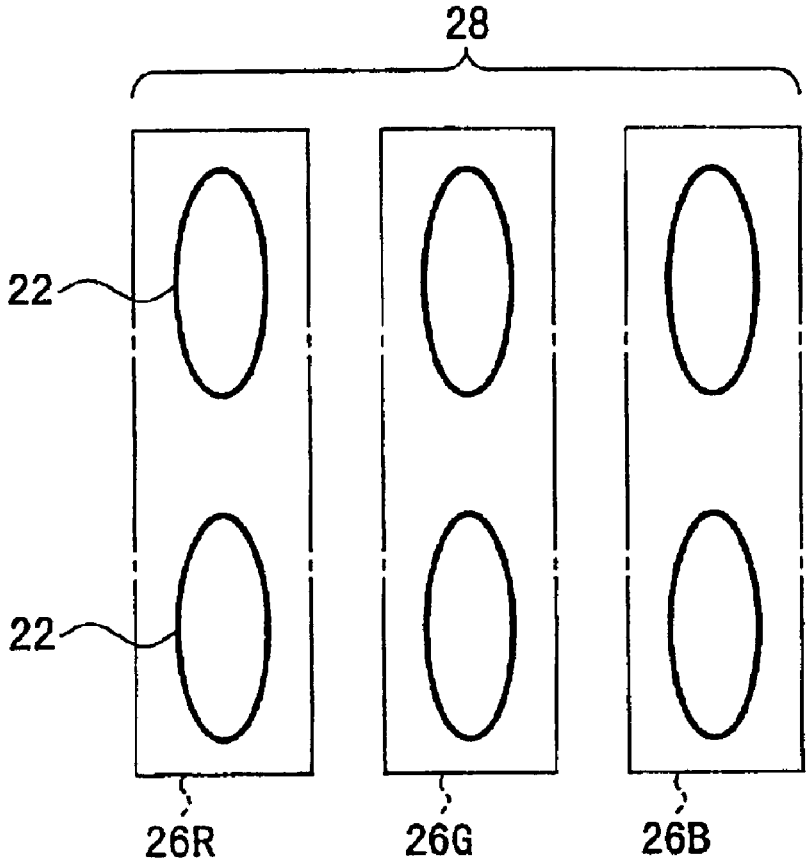
FIG. 2 is a view showing picture elements of the reflective display device.

The picture element array is shown in FIG. 2. One dot 26 is constructed by two actuator elements 22 which are aligned vertically. One picture element 28 is constructed by three dots 26 (red dot 26R, green dot 26G, and blue dot 26B) which are aligned horizontally. In the display device 10A, sixteen (48 dots) through thirty-two pieces (96 dots) of the picture elements 28 are arranged horizontally. Sixteen (16 dots) through thirty-two pieces (32 dots) of the picture elements 28 are arranged vertically. One dot 26 may be constructed by one actuator element 22 or at least two actuator elements 22.

In the display device 10A, as shown in FIG. 1, a picture element assembly 30 is stacked on each of the actuator elements 22. The contact area of the picture element assembly 30 with the display panel 20 increases to be an area corresponding to the picture element.

The driving section 24 includes an actuator substrate 32 composed of ceramics or the like. The actuator elements 22 are arranged at positions corresponding to the respective picture elements 28 on the actuator substrate 32. The actuator substrate 32 has a principal surface opposed to the back surface of the display panel 20. The principal surface is continuous (flushed). Hollow spaces 34 for forming respective vibrating sections as described later on are defined at positions corresponding to the respective picture elements 28 in the actuator substrate 32. The respective hollow spaces 34 are externally communicated via small through-holes 36. The through-holes 36 are defined at the other end surface of the actuator substrate 32.

The hollow space 34 is formed at the thin-walled portion of the actuator substrate 32. The other portion of the actuator substrate 32 is thick-walled. The thin-walled portion is susceptible to vibration in response to external stress and functions as a vibrating section 38. The thick-walled portion other than the hollow space 34 serves as a fixed section 40 for supporting the vibrating section 38.

The actuator substrate 32 is a stack including a substrate layer 32A as a lowermost layer, a spacer layer 32B as an intermediate layer, and a thin plate layer 32C as an uppermost layer. The actuator substrate 32 can be regarded as an integrated structure including the hollow spaces 34 defined at the positions in the spacer layer 32B corresponding to the actuator elements 22. The substrate layer 32A functions as a substrate for reinforcement and wiring. The actuator substrate 32 may be integrally sintered or may be additionally attached.

A light-absorptive material 14 is filled into the space between the display panel 20 and the actuator substrate 32. According to this embodiment, a light-absorptive liquid is used as the light-absorptive material 14.

Specific embodiments of the actuator element 22 and the picture element assembly 30 will now be explained with reference to FIGS. 3 to 8. According to the examples shown in FIGS. 3 to 8, a light-shielding layer 44 is disposed between the display panel 20 and a crosspiece 42 as described later on.

Figure 3:
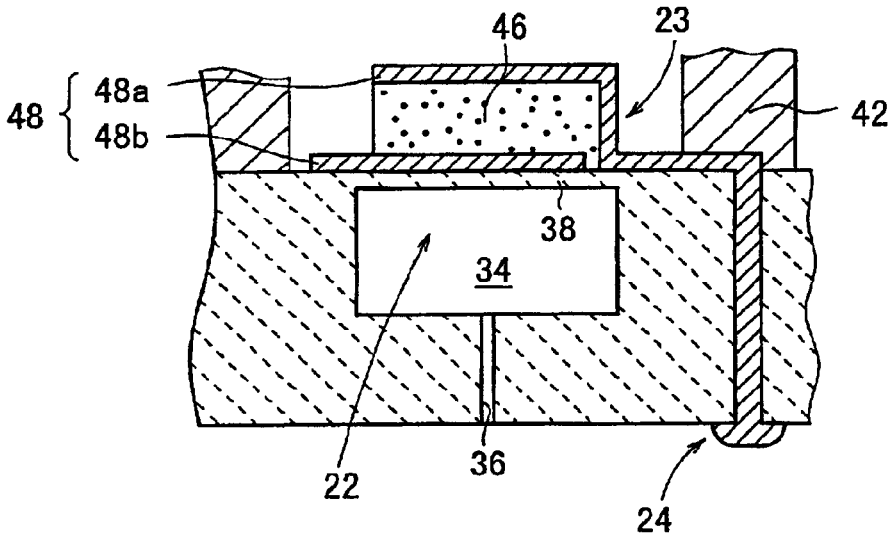
FIG. 3 is a view showing an actuator element.

As shown in FIG. 3, each of the actuator elements 22 has a main actuator element 23. The main actuator element 23 comprises the vibrating section 38 and the fixed section 40 described above, a shape-retaining layer 46 composed of, for example, a piezoelectric/electrostrictive layer or an antiferroelectric layer, and a pair of electrodes 48 (a row electrode 48*a* and a column electrode 48*b*). The shape-retaining layer 46 is disposed directly on the vibrating section 38. The pair of electrodes 48 are formed on upper and lower sides of the shape-retaining layer 46.

As shown in FIG. 3, the pair of electrodes 48 may be formed on upper and lower sides of the shape-retaining layer 46. They may also be formed on only a side of the shape-retaining layer 46. Further, the pair of electrodes 48 may be formed on only the upper portion thereof.

Figure 4:
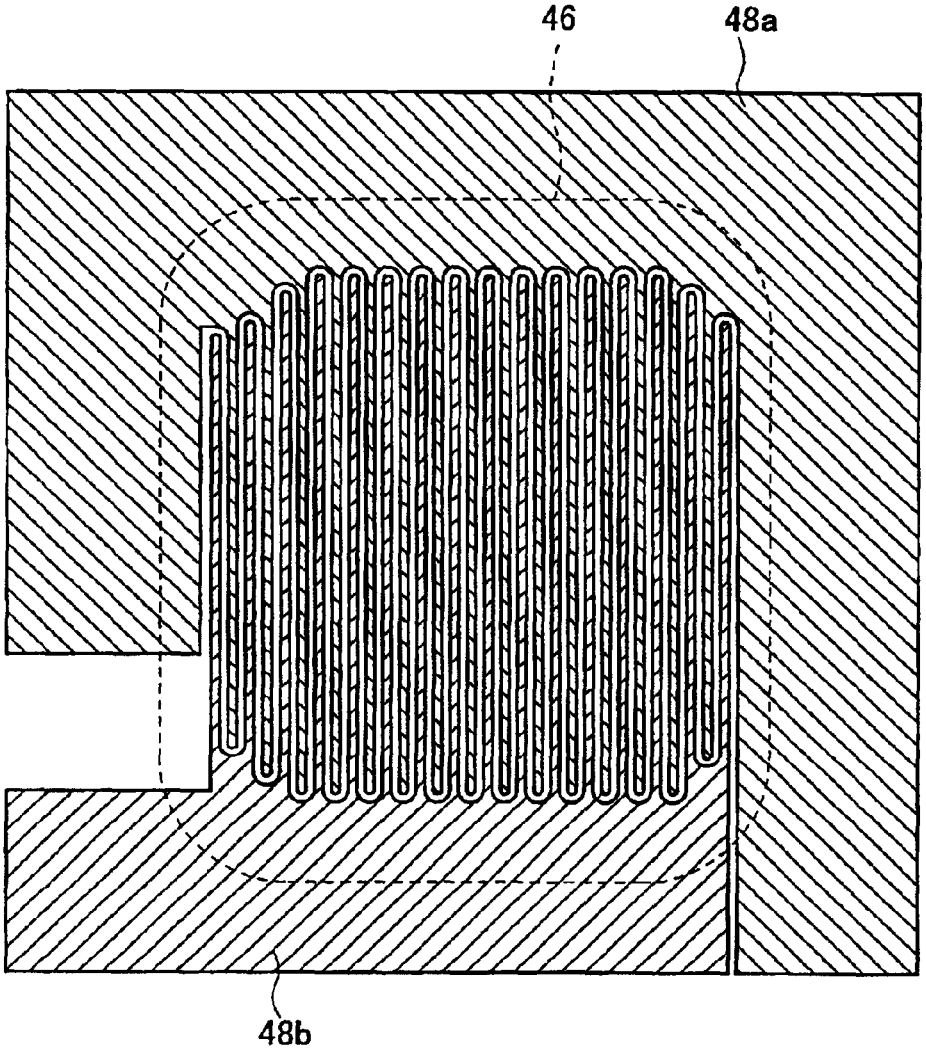
FIG. 4 is a view showing an example of a plane of a pair of electrodes formed on the actuator element.

When the pair of electrodes 48 are formed on only the upper portion of the shape-retaining layer 46, as shown in FIG. 4, a plurality of comb teeth are complementarily opposed in the plane of the pair of electrodes 48. As disclosed in Japanese Laid-Open Patent Publication No. 10-78549, spiral and branched shapes can also be formed in the plane thereof.

Figure 5A:
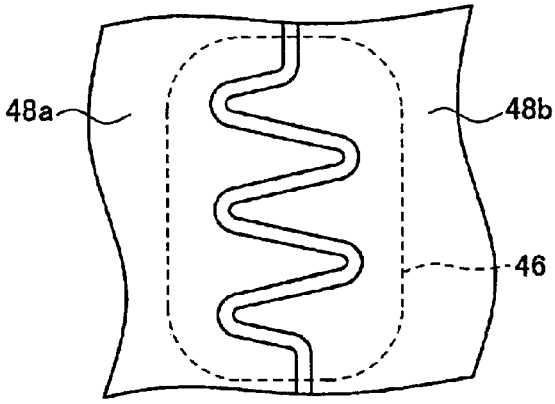
FIG. 5A is a view showing an example in which comb teeth of the pair of electrodes are arranged along the major axis of a shape-retaining layer.
Figure 5B:
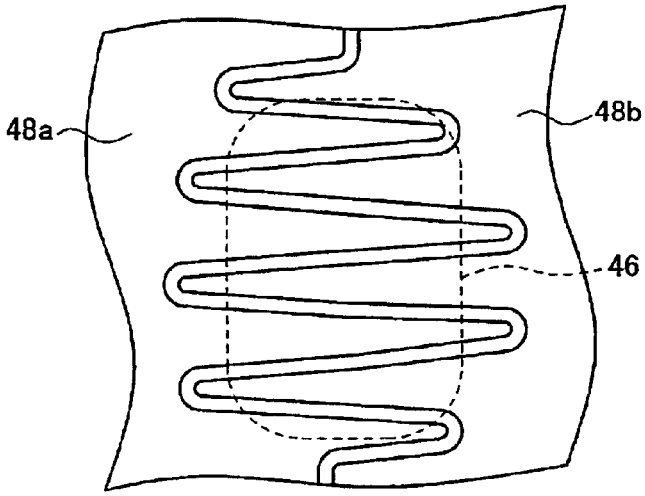
FIG. 5B is a view showing another example.

If the plane of the shape-retaining layer 46 is elliptic and the pair of electrodes 48 are of a comb teeth shape, for example, the comb teeth of the pair of electrodes 48 can be arranged along the major axis of the shape-retaining layer 46 as shown in FIGS. 5A and 5B. Further, the comb teeth of the pair of electrodes 48 can be arranged along the minor axis of the shape-retaining layer 46 as shown in FIGS. 6A and 6B.

Figure 6A:
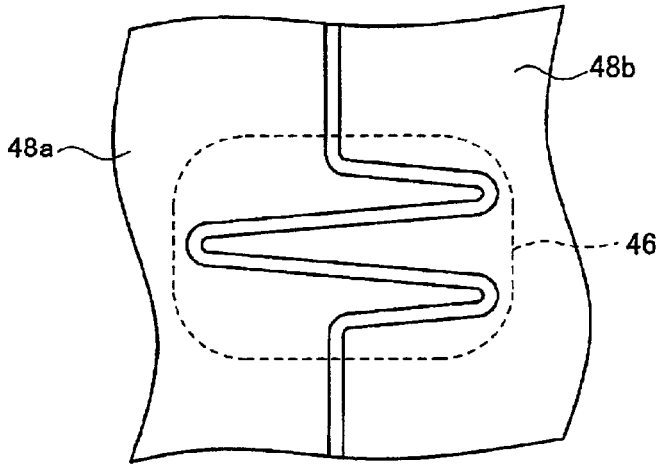
FIG. 6A is a view showing an example in which comb teeth of the pair of electrodes are arranged along the minor axis of a shape-retaining layer.
Figure 6B:
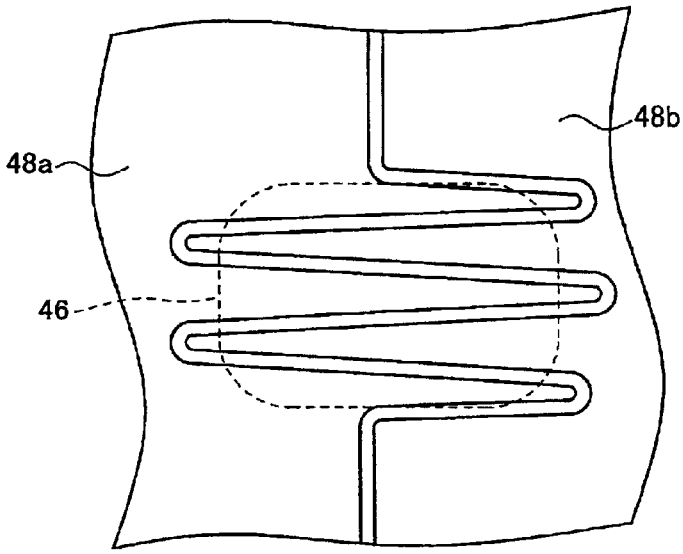
FIG. 6B is a view showing another example.

For example, the comb teeth of the pair of electrodes 48 can be included within the plane of the shape-retaining layer 46 as shown in FIGS. 5A and 6A. Further, the comb teeth of the pair of electrodes 48 can protrude out of the plane of the shape-retaining layer 48 as shown in FIGS. 5B and 6B. The forms shown in FIGS. 5B and 6B more advantageously bend the actuator element 22.

As shown in FIG. 3, the row electrode 48*a* of the pair of electrodes 48 is formed on the upper surface of the shape-retaining layer 46 and the column electrode 48*b* of the pair thereof is formed on the lower surface of the shape-retaining layer 46. In the above arrangement, the actuator element 22 can make bending displacement in a direction where it is convex toward the display panel 20 as shown in FIG. 1. Although not shown, the actuator element 22 can make the bending displacement in another direction where it is convex toward the hollow space 34.

As shown in FIG. 1, for example, the picture element assembly 30 can be a stack comprising a light-reflective layer 50 as a displacement-transmitting section formed on the main actuator element 23 and a color filter 52. According to this embodiment, a white scattering element is used as the light-reflective layer 50. A color scattering element may be used in place of color filter 52. A color scattering element may be used as the light-reflective layer. If the color filter 52 and the color scattering element are not formed, the picture element assembly 30 is the light-reflective layer 50.

As shown in FIG. 1, the display device 10A comprises the crosspieces 42 which are formed at the portions different from the picture element assembly 30 between the display panel 20 and the actuator substrate 32. Preferably, the material of the crosspiece 42 is not deformed by heat and pressure.

Figure 7:
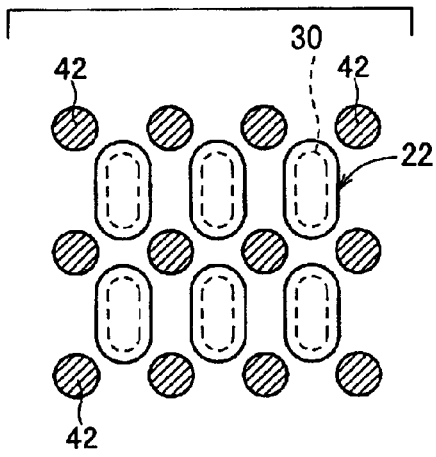
FIG. 7 is a view showing an arrangement in which crosspieces are formed at four corners of the picture element assemblies respectively.

The crosspieces 42 can be formed near four corners of the picture element assembly 30, for example. Specifically, FIG. 7 shows the crosspieces 42 formed near the four corners of the picture element assembly 30 having a substantially rectangular or elliptic plane shape. In FIG. 7, one crosspiece 42 is shared by the adjoining picture element assembly 30.

Figure 8:
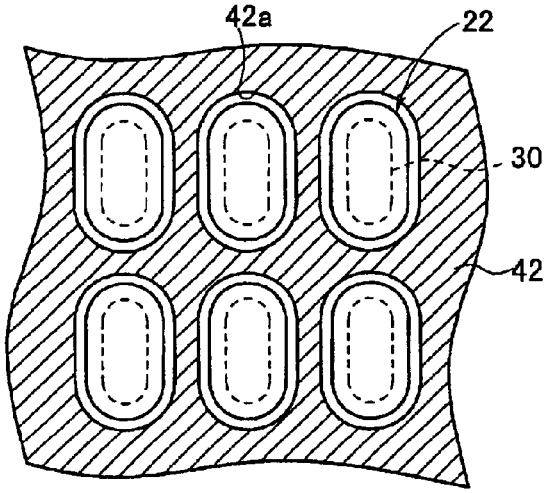
FIG. 8 is a view showing another arrangement of the crosspiece.
Figure 9:
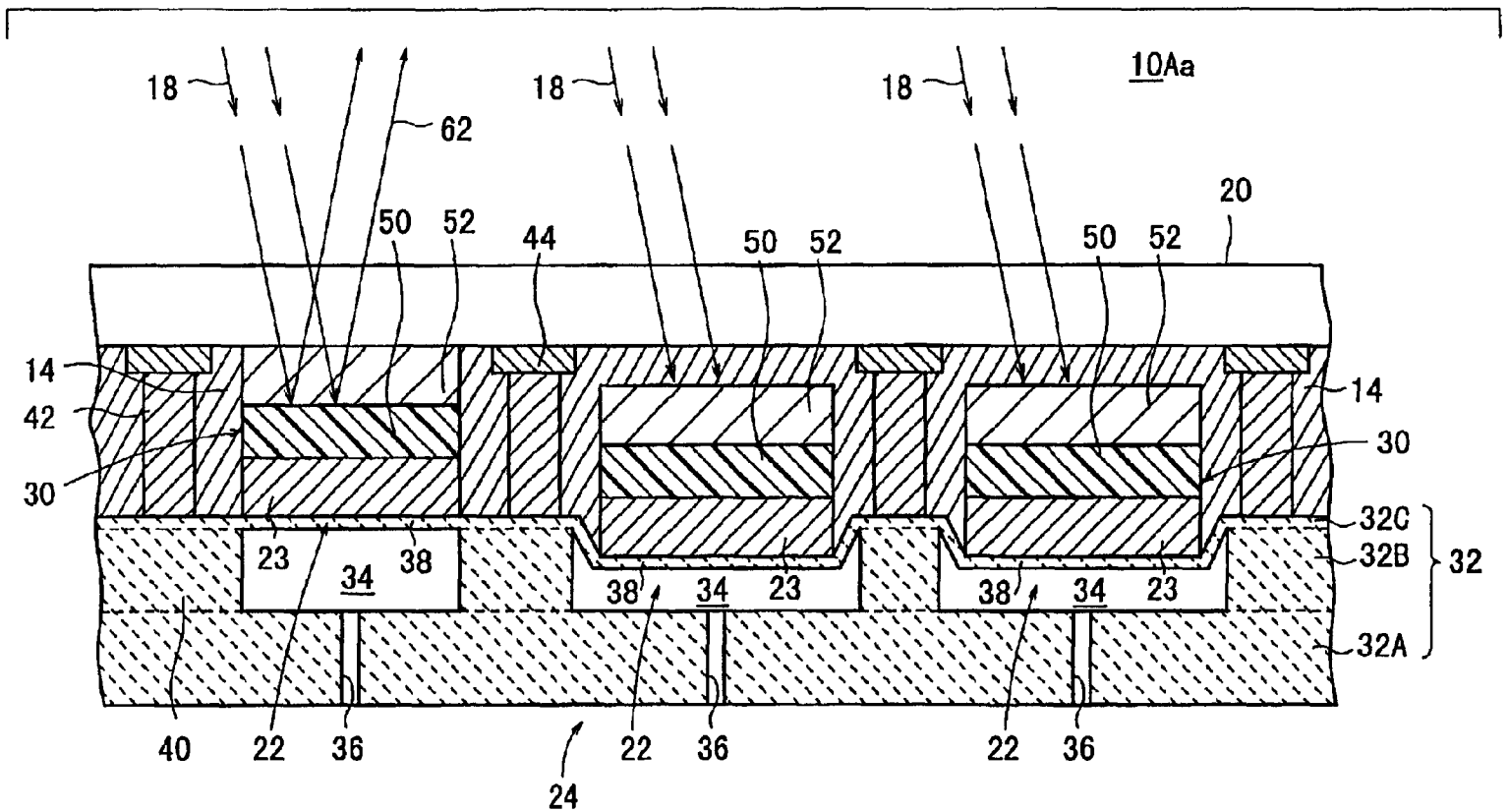
FIG. 9 is a view showing a first modified embodiment of the reflective display device according to the first embodiment.

Another example of the crosspiece 42 is shown in FIG. 8. The crosspiece 42 has windows 42*a* each surrounding at least one picture element assembly 30. According to representative illustrative arrangement, the crosspiece 42 is of a plate shape. The windows (openings) 42*a* having a shape similar to the outer shape of the picture element assembly 30 are formed at the positions corresponding to the picture element assemblies 30. All the side surfaces of the picture element assemblies 30 are consequently surrounded by the crosspiece 42 to secure the actuator substrate 32 and the display panel 20 with each other more tightly.

The respective constitutive members of the display device 10A will be explained below. Particularly, the selection of the material or the like of the respective constitutive member will be explained.

The light 18 radiated onto the display panel 20 may be any one of ultraviolet, visible, and infrared regions. As an unillustrated light source, it is possible to use incandescent lamp, deuterium discharge lamp, fluorescent lamp, mercury lamp, metal halide lamp, halogen lamp, xenon lamp, tritium lamp, light emitting diode, laser, plasma light source, hot cathode tube (or one arranged with carbon nano tube-field emitter instead of filament-shaped hot cathode), cold cathode tube or the like.

The vibrating section 38 is preferably composed of a highly heat-resistant material for the following reason. If the vibrating section 38 is directly supported by the fixed section 40 without using any material such as an organic adhesive inferior in heat resistance, the vibrating section 38 should not be deteriorated in quality at least during the formation of the shape-retaining layer 46.

The vibrating section 38 is preferably composed of an electrically insulative material in order to electrically separate the wiring connected to the row electrode 48*a* of the pair of electrodes 48 formed on the actuator substrate 22 from the wiring (for example, data line) connected to the column electrode 48*b*.

Therefore, the vibrating section 38 may be composed of a material such as a highly heat-resistant metal and a porcelain enamel produced by coating a surface of such a metal with a ceramic material such as glass. However, the vibrating section 38 is optimally composed of ceramics.

As the ceramics of the vibrating section 38, it is possible to use stabilized zirconium oxide, aluminum oxide, magnesium oxide, titanium oxide, spinel, mullite, aluminum nitride, silicon nitride, glass, mixtures thereof or the like. Stabilized zirconium oxide is particularly preferred because of, for example, high mechanical strength obtained even when the thickness of the vibrating section 38 is thin, high toughness, and small chemical reactivity with the shape-retaining layer 46 and the pair of electrodes 48. The term "stabilized zirconium oxide" includes fully stabilized zirconium oxide and partially stabilized zirconium oxide. Stabilized zirconium oxide has a crystal structure such as cubic crystal and does not cause phase transition.

Zirconium oxide causes phase transition between monoclinic crystal and tetragonal crystal at about 1000° C. Cracks may appear during the phase transition. Stabilized zirconium oxide contains 1 to 30 mole % of a stabilizer such as calcium oxide, magnesium oxide, yttrium oxide, scandium oxide, ytterbium oxide, cerium oxide, and oxides of rare earth metals. To improve the mechanical strength of the vibrating section 22, the stabilizer preferably contains yttrium oxide. In this composition, yttrium oxide is contained preferably in an amount of 1.5 to 6 mole %, and more preferably 2 to 4 mole %. Preferably, aluminum oxide is further contained in an amount of 0.1 to 5 mole %.

The crystal phase may be, for example, a mixed phase of cubic crystal+monoclinic crystal, a mixed phase of tetragonal crystal+monoclinic crystal, and a mixed phase of cubic crystal+tetragonal crystal+monoclinic crystal. However, a principal crystal phase composed of tetragonal crystal or a mixed phase of tetragonal crystal+cubic crystal is most preferable in terms of strength, toughness, and durability.

When the vibrating section 38 is composed of ceramics, a large number of crystal grains construct the vibrating section 38. To improve the mechanical strength of the vibrating section 38, the crystal grains preferably have an average grain diameter of 0.05 to 2 $\mu$m, and more preferably 0.1 to 1 $\mu$m.

The fixed section 40 is preferably composed of ceramics. The fixed section 40 may be composed of the same ceramic material as that used for the vibrating section 38, or the fixed section 40 may be composed of a ceramic material different from that used for the vibrating section 38. As the ceramic material of the fixed section 40, like the material of the vibrating section 38, it is possible to use stabilized zirconium oxide, aluminum oxide, magnesium oxide, titanium oxide, spinel, mullite, aluminum nitride, silicon nitride, glass, mixtures thereof or the like.

Specifically, as the actuator substrate 32 used in the display device 10A, it is possible to use materials containing a major component of zirconium oxide, a major component of aluminum oxide and a major component of a mixture thereof. The materials containing a major component of zirconium oxide are more preferable.

Clay or the like may be added as a sintering aid. However, it is necessary to control components of the sintering aid not to contain an excessive amount of silicon oxide, boron oxide or the like liable to form glass for the following reason. Although the materials liable to form glass advantageously join the actuator substrate 32 to the shape-retaining layer 46, they facilitate the reaction between the actuator substrate 32 and the shape-retaining layer 46. It is therefore difficult to maintain a predetermined composition of the shape-retaining layer 46. Consequently, the materials cause the element characteristics to deteriorate.

Silicon oxide or the like in the actuator substrate 32 is preferably restricted to have a weight ratio of not more than 3%, and more preferably not more than 1%. The term "major component" herein refers to a component which exists in a proportion of not less than 50% in weight ratio.

Piezoelectric/electrostrictive layers and anti-ferroelectric layers can be used as the shape-retaining layer 46. As the piezoelectric/electrostrictive layer of the shape-retaining layer 46, it is possible to use ceramics containing lead zirconate, lead magnesium niobate, lead nickel niobate, lead zinc niobate, lead manganese niobate, lead magnesium tantalate, lead nickel tantalate, lead antimony stannate, lead titanate, barium titanate, lead magnesium tungstate, and lead cobalt niobate, or any combination thereof or the like.

The major component contains the above compound in an amount of not less than 50% by weight. The ceramic material containing lead zirconate is most frequently used among the above ceramic materials as the constitutive material of the piezoelectric/electrostrictive layer of the shape-retaining layer 46.

When the piezoelectric/electrostrictive layer is composed of ceramics, it is also preferable to use ceramics added with oxide of lanthanum, calcium, strontium, molybdenum, tungsten, barium, niobium, zinc, nickel, and manganese, or a combination thereof or another type of compound thereof.

For example, it is preferable to use ceramics containing a major component composed of lead magnesium niobate, lead zirconate, and lead titanate and further containing lanthanum and strontium.

The piezoelectric/electrostrictive layer may be either dense or porous. Porosity of the porous piezoelectric/electrostrictive layer is preferably not more than 40%.

As the anti-ferroelectric layer for the shape-retaining layer 46, it is desirable to use a compound containing a major component composed of lead zirconate, a compound containing a major component composed of lead zirconate and lead stannate, a compound obtained by adding lanthanum to lead zirconate, and a compound obtained by adding lead zirconate and lead niobate to a component composed of lead zirconate and lead stannate.

Driving can be preferably performed at a relatively low voltage particularly if an anti-ferroelectric film composed of lead zirconate and lead stannate represented by the following composition is applied as a film-type element such as the actuator element 22.

$$Pb_{0.99}Nb_{0.02}[(Zr_xSn_{1-x})_{1-y}Ti_y]_{0.98}O_3$$

wherein, $0.5<x<0.6$, $0.05<y<0.063$, $0.01<Nb<0.03$.

The anti-ferroelectric film may be porous. The porosity of the porous anti-ferroelectric film is desirably not more than 30%.

As the method for forming the shape-retaining layer 46 on the vibrating section 38, it is possible to use various thick film formation methods such as the screen printing method, the dipping method, the application method, and the electrophoresis method. It is also possible to use various thin film formation methods such as the ion beam method, the sputtering method, the vacuum evaporation method, the ion plating method, the chemical vapor deposition method (CVD), and the plating.

In this embodiment, when the shape-retaining layer 46 is formed on the vibrating section 38, the thick film formation method is preferably adopted based on the screen printing method, the dipping method, the application method, and the electrophoresis method for the following reason.

In the above techniques, the shape-retaining layer 46 can be formed by paste, slurry, suspension, emulsion, or sol containing a major component of piezoelectric ceramic particles having an average grain size of 0.01 to 5 $\mu$m, preferably 0.05 to 3 $\mu$m, in which it is possible to obtain good piezoelectric operation characteristics.

Specifically, the electrophoresis method can form the film at a high density with a high shape accuracy. Further, the electrophoresis method has the features as described in technical literatures such as "Electrochemistry and Industrial Physical Chemistry, Vol. 53, No. 1 (1985), pp. 63–68, written by Kazuo ANZAI" and "Proceedings of First Study Meeting on Higher Order Ceramic Formation Method Based on Electrophoresis (1998), pp. 5–6 and pp. 23–24". Therefore, the technique may be appropriately selected and used considering the required accuracy and the reliability.

Preferably, the thickness of the vibrating section 38 is identical to that of the shape-retaining layer 46 for the following reason. If the thickness of the vibrating section 38 is greatly larger than that of the shape-retaining layer 46 (over one figure), the vibrating section 38 prevents the shape-retaining layer 46 from shrinking upon sintering. Therefore, the stress at the boundary surface between the shape-retaining layer 46 and the actuator substrate 22 increases to easily peel the shape-retaining layer 46 and the actuator substrate 22 off from each other. If the vibrating section 38 and the shape-retaining layer 46 have the same thickness, by contrast, the actuator substrate 32 (vibrating section 38) easily follows the shrinkage of the shape-retaining layer 46 upon sintering for achieving preferable integration. Specifically, the vibrating section 38 preferably has a thickness of 1 to 100 μm, more preferably 3 to 50 μm, and much more preferably 5 to 20 μm. The shape-retaining layer 46 preferably has a thickness of 5 to 100 μm, more preferably 5 to 50 μm, and much more preferably 5 to 30 μm.

The row electrode 48*a* and the column electrode 48*b* formed on upper and lower surfaces of the shape-retaining layer 46, or the pair of electrodes 34 formed on the shape-retaining layer 46 have an appropriate thickness depending on the usage. However, the thickness is preferably 0.01 to 50 μm, and more preferably 0.1 to 5 μm. The row electrode 48*a* and the column electrode 48*b* are preferably composed of a conductive metal which is solid at room temperature. The metal includes, for example, metal simple substances or alloys containing, for example, aluminum, titanium, chromium, iron, cobalt, nickel, copper, zinc, niobium, molybdenum, ruthenium, rhodium, silver, stannum, tantalum, tungsten, iridium, platinum, gold, and lead. These elements may be contained in an arbitrary combination.

The material for the display panel 20 is not limited as long as it has transparency. However, it is possible for the display panel 20 to use glass, quartz, light-transmissive plastics such as acrylic plastics, light-transmissive ceramics, structural materials comprising a plurality of layers composed of materials having different refractive indexes, and those having a surface coating layer.

The color layer such as the color filter 52 and the color scattering element included in the picture element assembly 30 extracts only the light in a specific wavelength region. For example, such a color layer develops the color by absorbing, transmitting, reflecting, or scattering the light at a specific wavelength and converts incident light into light of a different wavelength. The transparent member, the semitransparent member, and the opaque member can be used singly or in combination.

The color layer is obtained by one of the following manners: dispersing or dissolving a dyestuff or a fluorescent material such as dye, pigment, and ion in rubber, organic resin, light-transmissive ceramic, glass, liquid or the like; applying the dyestuff or the fluorescent material on the surface of the above material; sintering the powder of the dyestuff or the fluorescent material; and pressing and solidifying the powder of the dyestuff or the fluorescent material. As for the quality and the structure, they may be used singly or in combination.

The picture element assembly 30 is displaced near the display panel 20 to emit light. If the brightness value of leakage light of reflection and scattering in only the color layer is more than half of that of leakage light of reflection and scattering in the entire structure including the picture element assembly 30 and the actuator element 22, then the color layer is defined as the color scattering element. Inversely, if the brightness value in only the color layer is less than half of the brightness value in the entire structure including the picture element assembly 30 and the actuator element 22, the color layer is defined as the color filter 52.

The measuring method is specifically exemplified below. It is assumed that when the color layer singly contacts the back surface of the display panel 20 which is irradiated with the light 18, A(nt) represents the front luminance or brightness of the light which passes from the color layer through the display panel 20 and which leaks to the front surface. Further, it is assumed that when the picture element assembly 30 contact the surface of the color layer on the side opposite to the side to contact the display panel 20, B(nt) represents the front luminance or brightness of the light which leaks to the front surface. If $A \geqq 0.5 \times B$ is satisfied, the color layer is the color scattering element. If $A < 0.5 \times B$ is satisfied, the color layer is the color filter 52.

The front brightness is measured by arranging a luminance meter so that the line which connects the color layer to the luminance meter for measuring the brightness is perpendicular to the surface of the display panel 20 to contact the color layer (the detection surface of the luminance meter is parallel to the board surface of the display panel 20).

The color scattering element is advantageous in that the color tone and the brightness are scarcely changed depending on the thickness of the layer. Accordingly, various methods are applicable to form the layer. For example, the screen printing is applicable which does not require expensive cost although it is difficult to strictly control the layer thickness.

Because the color scattering element also serves as the displacement-transmitting section, the process for forming the layer can be simple and the entire layer can be thin. Therefore, the thickness of the entire display device 10A can be decreased. It is also possible to prevent the displacement amount of the actuator element 22 from decreasing and to improve the response speed.

In the color filter 52, the layer can be easily formed on the side of the display panel 20 because the display panel 20 is flat and has high surface smoothness. Thus, the range of process selection is widened, and the cost becomes inexpensive. Further, it is easy to control the layer thickness which may affect the color tone and the brightness.

The method for forming the film of the light-reflective layer 50, the color filter 52 and the color scattering element is not specifically limited. It is possible to apply thereto various known film formation methods. For example, it is possible to use a film lamination method in which the color layer of a chip or film form is directly stuck on the surface of the display panel 20 or the actuator element 22. It is also possible to use a method for forming the light-reflective layer 50 or the color filter 52. According to this method, powder, paste, liquid, gas, ion or the like to serve as a raw material for the color filter 52 or the light-reflective layer 50 (white scattering element in this embodiment) is formed into a film by the thick film formation method or by the thin film formation method. The thick film formation method includes the screen printing, the photolithography method, the spray dipping and the application. The thin film formation method includes the ion beam, the sputtering, the vacuum evaporation, the ion plating, CVD, and the plating.

Alternatively, it is also preferable that a light emissive layer is provided for a part or all of the picture element assembly 30. A fluorescent layer can be used as the light-emissive layer. The fluorescent layer is excited by invisible light (ultraviolet light and infrared light) or visible light to emit visible light. Either one of them may be used.

A fluorescent pigment may be also used for the light-emissive layer. If the fluorescent pigment is added with fluorescent light of a wavelength approximately coincident with the color of the pigment, i.e., the color of the reflected light, then the color stimulus becomes large to emit the vivid light. Therefore, the fluorescent pigment is used more preferably to obtain the high brightness for the display component and the display. A general daylight fluorescent pigment is preferably used.

A stimulus fluorescent material, a phosphorescent material, or a luminous pigment is also used for the light-emissive layer. These materials may be either organic or inorganic.

The light-emissive layer is preferably formed from only the above light-emissive material. Alternatively, the light-emissive material may be dispersed in resin or dissolved in resin.

The afterglow or decay time of the light-emissive material is preferably not more than 1 second, more preferably 30 milliseconds. More preferably, the afterglow or decay time is not more than several milliseconds.

When the light-emissive layer is used as a part or all of the picture element assembly 30, the unillustrated light source is not specifically limited if it includes the light having a wavelength capable of exciting the light-emissive layer and it has an energy density sufficient for excitation. For example, as the unillustrated light source, it is possible to use cold cathode tube, hot cathode tube (or one arranged with carbon nano tube-field emitter in place of filament-shaped hot cathode), metal halide lamp, xenon lamp, laser including infrared laser, black light, halogen lamp, incandescent lamp, deuterium discharge lamp, fluorescent lamp, mercury lamp, tritium lamp, light emitting diode, and plasma light source or the like.

Next, the operation of the reflective display device 10A will be briefly explained with reference to FIG. 1. The display panel 20 is irradiated with the light 18.

In this embodiment, in the natural state for all of the actuator elements 22, the actuator element is in the OFF state. The end surface of the picture element assembly 30 is separated from the back surface of the display panel 20.

Accordingly, the light-absorptive liquid 14 exists between the end surfaces of all of the picture element assemblies 30 and the back surface of the display panel 20. As a result, the light 18, which is radiated onto the display panel 20, is absorbed by the light-absorptive liquid 14. A light emission is stopped in the OFF state. The black color is displayed on the screen of the display device 10A.

Next, when the ON signal is applied to the actuator element 22 corresponding to a certain dot 26, the actuator element 22 makes the bending displacement in the direction where it is convex toward the display panel 20 as shown in FIG. 1. The end surface of the picture element assembly 30 contacts the back surface of the display panel 20. In this situation, the light-absorptive liquid 14, which has been present over the end surface of the picture element assembly 30, is expelled to the outside (surroundings) of the picture element assembly 30. The end surface of the picture element assembly 30 directly contacts the back surface of the display panel 20.

At this stage, the light 18 is reflected at the surface of the light-reflective layer 50 of the picture element assembly 30, and the light 18 is converted into the scattered light 62. A part of the scattered light 16 is reflected again in the display panel 20. However, most of the scattered light 62 is transmitted through the front surface (surface) of the display panel 20 without being reflected by the display panel 20.

Accordingly, the actuator element 22, to which the ON signal is applied, is in the ON state. The light emission is effected in the ON state. Further, the color of emitted light corresponds to that of the color filter 52 included in the picture element assembly 30.

In the display device 10A, the light transmission through the light-absorptive liquid 14 can be controlled between the display panel 20 and the picture element assembly 30 by the displacement of the picture element assembly 30 in a direction closer to or away from the display panel 20.

Specifically, in the display device 10A, one unit of displacing the picture element assembly 30 in the direction closer to or away from the display panel 20 is vertically arranged to be used as one dot. The horizontal array of the three dots (red dot 26R, green dot 26G, and blue dot 26B) is used as one picture element. A large number of the picture elements are arranged in a matrix configuration or in a zigzag configuration concerning the respective rows. Therefore, it is possible to display a color screen image (characters and graphics) corresponding to the image signal on the front surface of the display panel 20, i.e., on the display surface, in the same manner as in the cathode ray tube, the liquid crystal display device, and the plasma display, by controlling the displacement in each of the picture elements depending upon the attribute of the inputted image signal.

In the display device 10A of the first embodiment, thus, it is not necessary to introduce the external light or the light 18 from the light source so that the light 18 is totally reflected in the display panel 20. It is sufficient for the display device 10A to simply irradiate the display panel 20 with the external light or the light 18 from the light source. Therefore, the arrangement for introducing the external light or the light 18 from the light source can be greatly simplified.

Further, in the OFF state of the actuator element 22, the light-absorptive liquid 14 exists between the display panel 20 and the end surface of the picture element assembly 30 corresponding to the actuator element 22. Therefore, the light emission can be reliably stopped. The crosstalk for the display scarcely appears. The brightness and the contrast can be improved, and the quality of the displayed image can be improved.

According to the above embodiment, the end surface of the picture element assembly 30 is separated from the display panel 20 in the natural state of the actuator element 22, and the end surface of the picture element assembly 30 contacts the display panel 20 by applying the ON signal. Alternatively, as illustrated by a display device 10Aa of a first modified embodiment shown in FIG. 9, the end surface of the picture element assembly 30 preferably contacts the display panel 20 in the natural state of the actuator element 22. Further, the end surface of the picture element assembly 30 is separated from the display panel 20 by applying the OFF signal.

Figure 10:
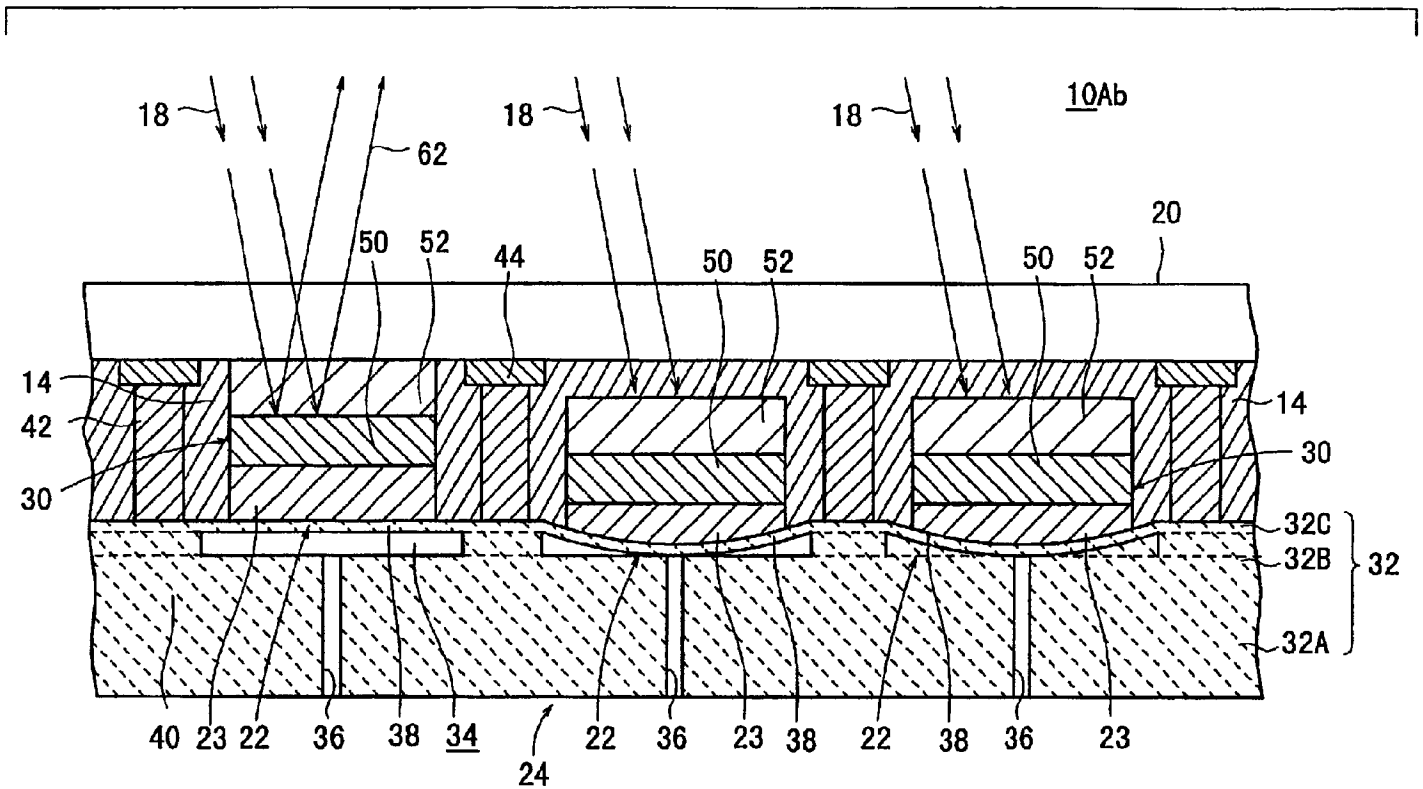
FIG. 10 is a view showing a second modified embodiment of the reflective display device according to the first embodiment.

Alternatively, as illustrated by a display device 10Ab of a second modified embodiment shown in FIG. 10, the thickness of a spacer layer 32B of an actuator substrate 32 is preferably decreased.

The hollow space 34 is defined in the spacer layer 32B of the actuator substrate 32. Although the thickness of the spacer layer 32B is not particularly limited, it may be determined depending on the purpose of using the hollow space 34. Specifically, as shown in FIG. 10, the spacer layer 32B does not have any excessive thickness which is not necessary to function the actuator element 22. The thickness of the spacer layer 32B preferably corresponds to the displacement amount of the utilized actuator element 22. The thickness of the thin plate layer 32C is usually not more than 50 $\mu$m and preferably about 3 to 20 $\mu$m, in order to greatly displace the actuator element 22.

According to the above arrangement, the flexible bending of the thin-walled portion (portion of the vibrating section 38) is restricted by the substrate layer 32A located near the direction of flexible bending. The thin-walled portion is prevented from being deconstructed, which would be otherwise caused if unexpected external force is applied. The displacement of the actuator element 22 can be stabilized to have a specified value by utilizing the effect to restrict the flexible bending brought about by the substrate layer 32A.

When the spacer layer 32B is thin, then it is possible to reduce the thickness of the actuator substrate 32 and to decrease the bending rigidity. Therefore, when the actuator substrate 32 is bonded and fixed to another member, then any warpage or the like (of the actuator substrate 32 in this case) with respect to the partner (for example, the display panel 20) is effectively corrected and it is possible to improve the reliability of the bonding and the fixation.

The entire actuator substrate 32 is constructed to be thin for making it possible to reduce the amount of using raw materials when the actuator substrate 32 is produced. This structure is also advantageous in terms of the production cost. Specifically, the thickness of the spacer layer 32B is preferably 3 to 5 $\mu$m, and particularly preferably 3 to 20 $\mu$m.

The thickness of the substrate layer 32A is generally 50 $\mu$m, and preferably about 80 to 300 $\mu$m to reinforce the entire actuator substrate 32 because the spacer layer 32B is thin as described above.

Next, a reflective display device 10B of a second embodiment will be explained with reference to FIG. 11. Components or parts corresponding to those shown in FIG. 1 are designated by the same reference numerals, duplicate explanation of which will be omitted.

Figure 11:
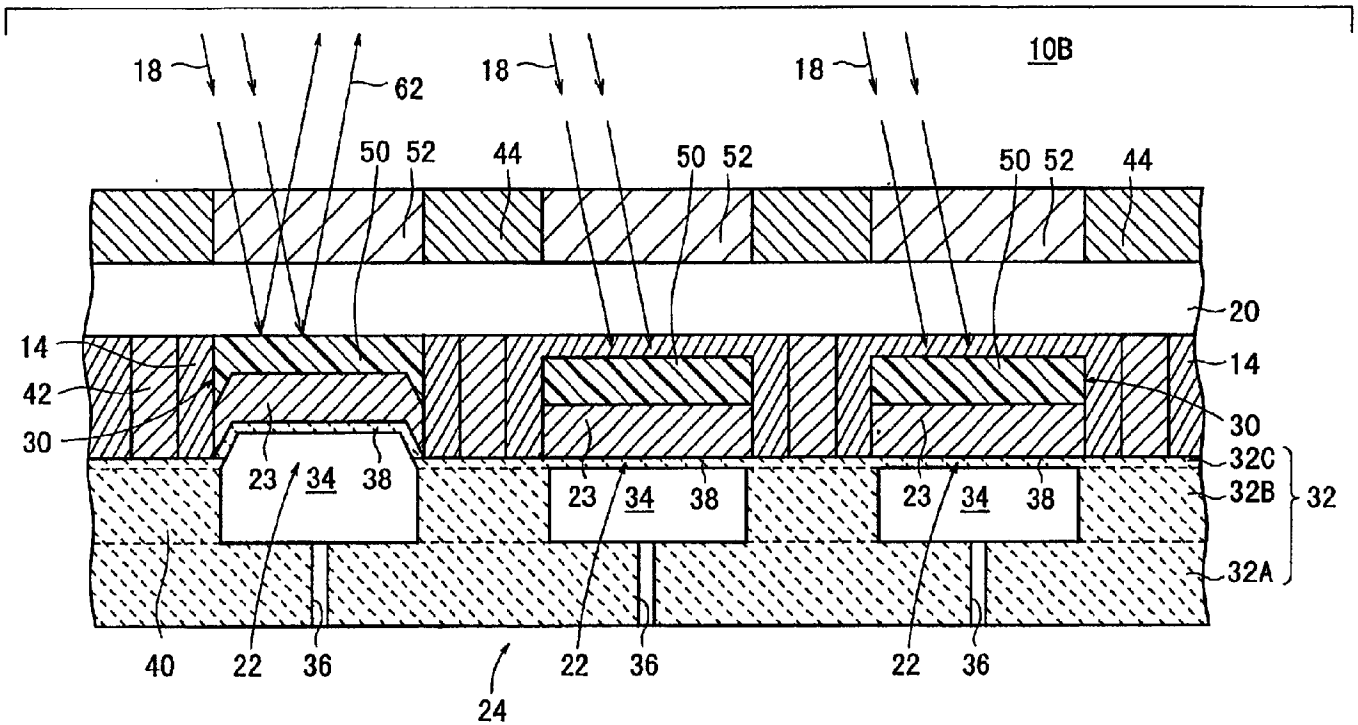
FIG. 11 is a view showing a reflective display device according to a second embodiment.

As shown in FIG. 11, the reflective display device 10B of the second embodiment is constructed in approximately the same manner as the reflective display device 10A of the first embodiment. However, the picture element assembly 30 is constructed by a light-reflective layer 50 which is formed on the main actuator element 23. Further, a color filter 52 is formed on the surface of the display panel 20. A light-shielding layer 44 is formed between the respective color filters 52 to reduce the crosstalk for the display and to improve the contrast.

In the reflective display device 10B of the second embodiment, like the reflective display device 10A of the first embodiment, it is possible to simplify the arrangement for introducing the external light and the light from the light source, to improve the brightness, to improve the contrast, and to improve the quality of the display image.

Figure 12:
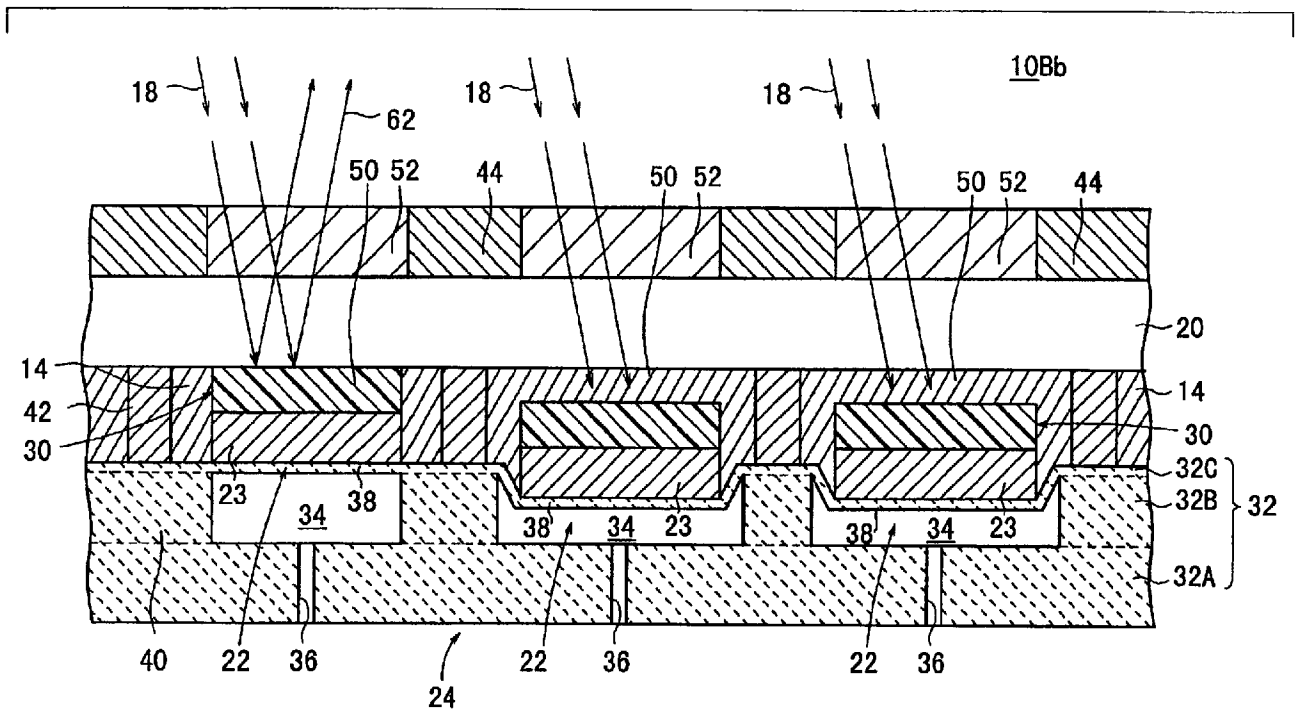
FIG. 12 is a view showing a modified embodiment of the reflective display device according to the second embodiment.

As illustrated by a reflective display device 10Ba of a modified embodiment shown in FIG. 12, the end surface of the picture element assembly 30 preferably contacts the display panel 20 in the natural state of the actuator element 22. The end surface of the picture element assembly 30 is separated from the display panel 20 by applying the OFF signal.

Figure 13:
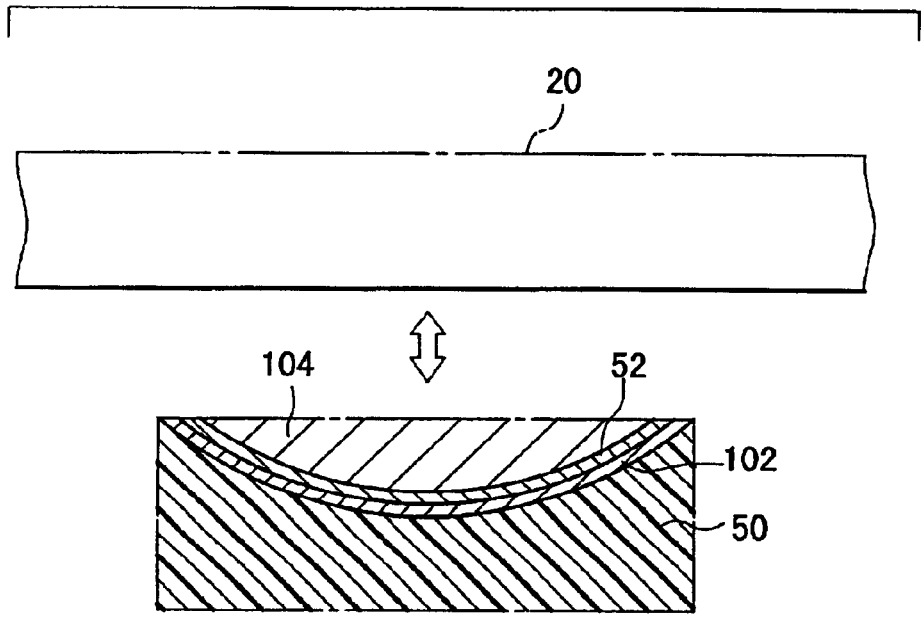
FIG. 13 is a view showing an example in which an upper portion of a picture element assembly has a parabola-shaped configuration.
Figure 14:
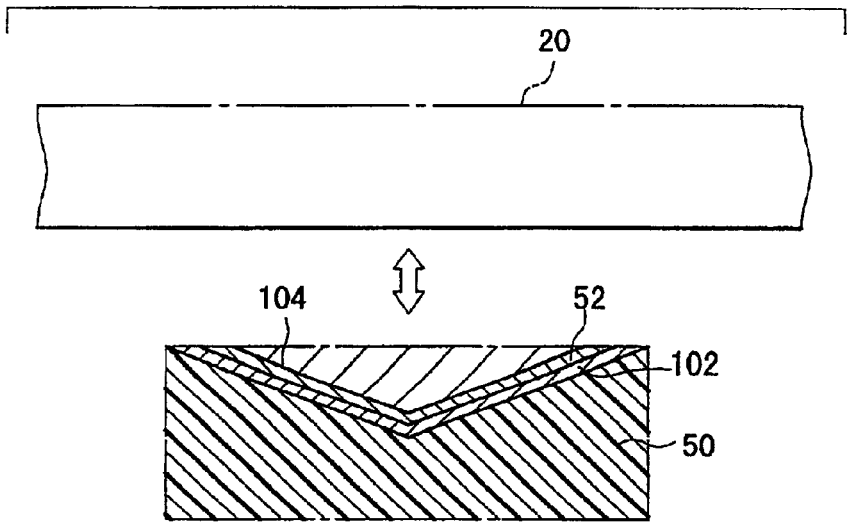
FIG. 14 is a view showing an example in which an upper portion of a picture element assembly has a conical configuration.

According to the above embodiment, the shape of the picture element assembly 30, particularly the shape of the end surface of each of the color filter 52 and the light-reflective layer 50 is flush. Alternatively, as shown in FIGS. 13 and 14, the upper portion of the light-reflective layer 50 of the picture element assembly 30 may have a parabola shape, a conical shape, a saw teeth shape, or a dome shape. In the above arrangement, preferably, a second light-reflective layer 102 of aluminum or the like and a color filter 52 are stacked on the surface and a transparent layer 104 with a flushed end surface is charged.

The drawings show that the light-absorptive material 14 is filled into the entire space between the actuator substrate 32 and the display panel 20. However, it is also preferable that the light-absorptive material 14 locally exists near the back surface of the display panel 20 or on the upper surface of the picture element assembly 30.

Next, a reflective display device 10C of a third embodiment will be explained with reference to FIG. 15.

Figure 15:
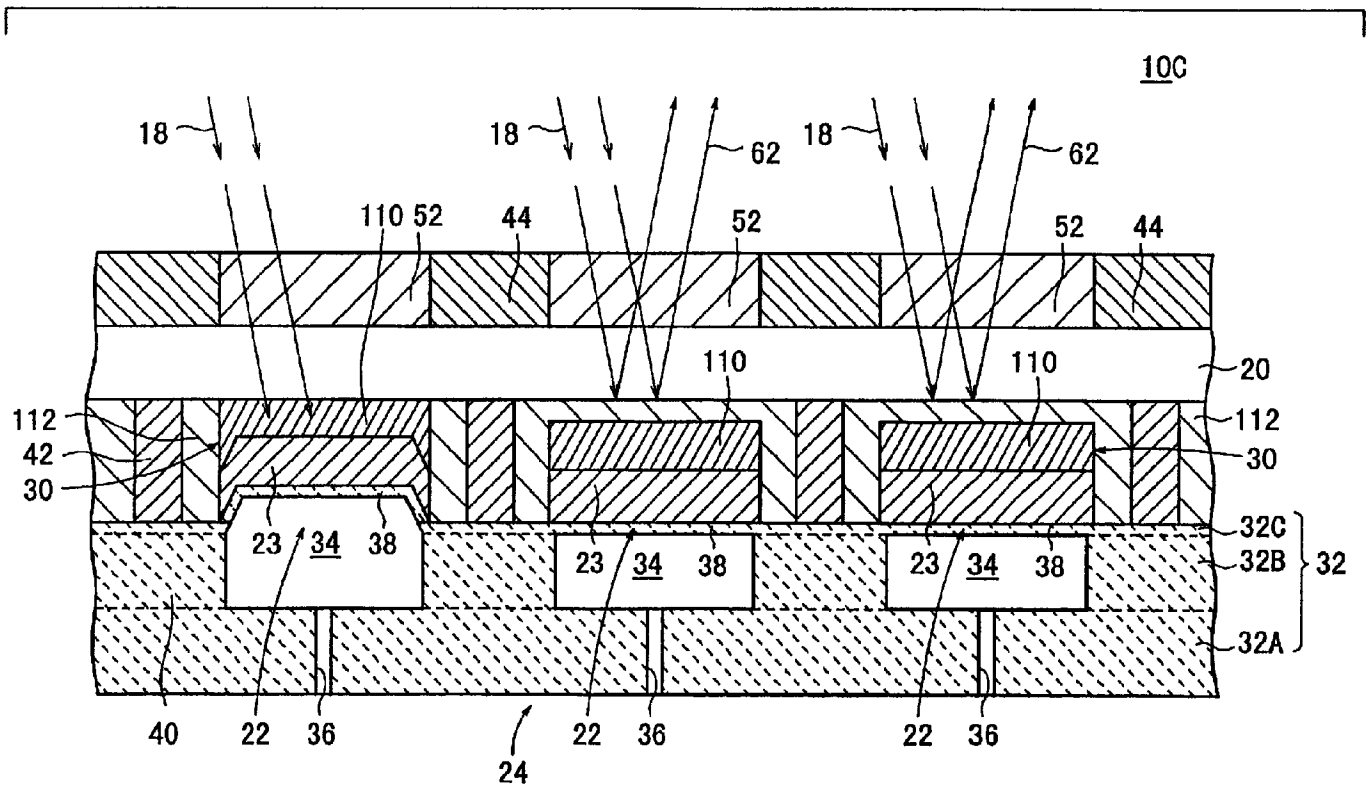
FIG. 15 is a view showing a reflective display device according to a third embodiment.
Figure 16:
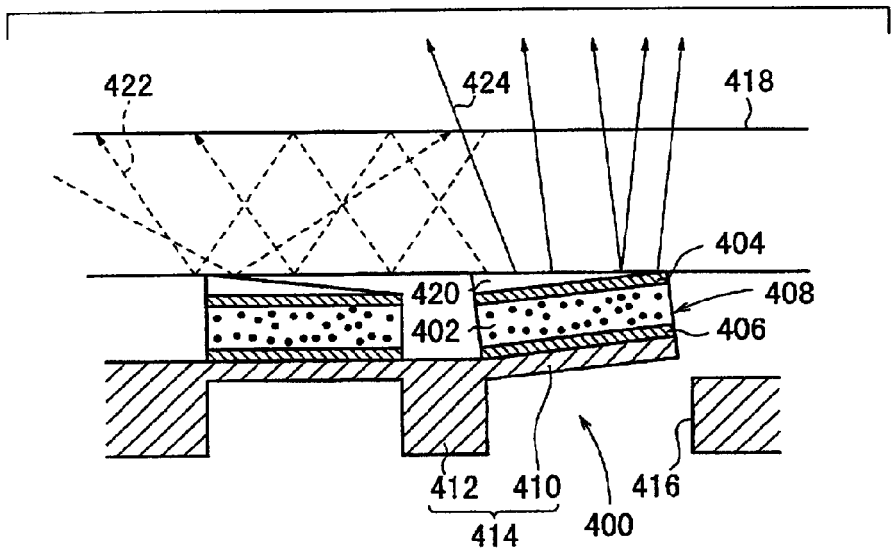
FIG. 16 PRIOR ART
FIG. 16 is a view showing a proposed exemplary display device.

As shown in FIG. 15, the reflective display device 10C of the third embodiment is constructed in substantially the same manner as the reflective display device 10B of the second embodiment. However, a picture element assembly 30 comprises a light-absorbing layer 110 formed on the main actuator element 23, and a color filter 52 formed on the surface of the display panel 20. Further, a light-reflective material 112 is filled into the space between the display panel 20 and the actuator substrate 32. According to this embodiment, a light-reflective liquid is used for the light-reflective material 112.

This arrangement is in opposite relation to the reflective display device 10B of the second embodiment concerning the dot for which the end surface of the picture element assembly 30 is separated from the display panel 20 such that the light 18 is reflected at the surface of the light-reflective material 112, and it is converted into scattered light 62, because the light-reflective material 112 contacts the back surface of the display panel 20. Most of the scattered light 62 is transmitted through the front surface (surface) of the display panel 20 without being reflected by the display panel 20. The light is thus emitted.

As for the dot for which the end surface of the picture element assembly 30 contacts the back surface of the display panel 20, the light-absorbing layer 110 contacts the back surface of the display panel 20. Therefore, the light 18 is absorbed by the light-absorbing layer 110 to stop the light emission.

In the reflective display device 10C of the third embodiment, it is possible to simplify the arrangement for introducing the external light and the light 18 from the light source, improve the brightness, improve the contrast, and improve the quality of the display image, in the same manner as in the reflective display device 10A of the first embodiment.

For example, a blue light-reflective material may be used as the light-reflective material 112. In this case, the black color can be displayed on the blue background.

Preferred embodiments of the reflective display devices 10A, 10B and 10C will be explained by the first to third embodiments.

The light-absorptive material 14 of each of the reflective display devices 10A, 10B of the first and second embodiments is not limited to the black. For example, a blue light-absorptive material may be used. If no color filter 52 is used in this case, the white dot can be displayed on the blue background. If a red color filter is used in combination, further, the red dot can be displayed on the blue background. In this way, it is possible to select an arbitrary background color and an arbitrary display color by combining the color filter 52 and the light-absorptive material 14.

Similarly, when the light-absorbing layer 110 is formed as the constitutive element of the picture element assembly 30 as in the reflective display device 10C of the third embodiment, it is possible to display the black color on the blue background.

As the light-absorptive material 14, it is possible to use black or colored liquid, solution, gel, resin material having flexibility or the like. It is also possible to use a sponge impregnated with the liquid.

As the light-reflective material 112, it is possible to use white, silver, or colored liquid, solution, gel, sponge, resin material having flexibility, mercury or the like. It is also possible to use a sponge impregnated with the liquid.

For example, as the method for controlling the light-transmitting property of the light-absorptive material 14 or the light-reflective material 112, it is preferable to change the thickness of the light-absorptive material 14 or the light-reflective material 112 (distance between the display panel 20 and the picture element assembly 30) by the displacement of the actuator element. The value of the thickness and the displacement amount thereof are not particularly limited. However, those particularly preferably used are not less than 0.1 μm and not more than 10 μm.

A concave/convex structure may be provided at a portion of the picture element assembly 30 facing the light-absorptive material 14 or the light-reflective material 112. When the light-absorptive material 14 and/or the light-reflective material 112 is a fluid, the response performance of emitting the light and stopping the light emission is improved because the concave/convex structure forms a flow passage. A convex type structure is also preferably used.

It is also preferable to provide and use a transparent layer at a portion of the picture element assembly 30 facing the light-absorptive material 14 or the light-reflective material 112. The transparent layer adjusts the height of the picture element assembly 30 so as to uniformize the thickness of the light-absorptive material 14 and/or the light-reflective material 112 between the display panel 20 and the picture element assembly 30 in the natural state of the actuator element 22. The concave/convex structure or the convex surface configuration may be formed for the transparent layer.

Further, it is possible to improve the light emission luminance and/or the contrast by radiating the light from the light source onto the display panel 20, making it possible to enhance the performance of visual recognition. As for the gradational expression system, it is preferable to use any one of or a combination of the area gradation, the time gradation, and the voltage gradation.

An ultrathin type low electric power-consuming display can be advantageously constructed by the reflective display devices 10A to 10C of the first to third embodiments. Therefore, the display devices 10A to 10C of the present invention are effective for a large screen display in which a plurality of display devices 10A to 10C of the present invention are arranged vertically and laterally respectively. Such a display requires no projection space as compared with a projector, which can be installed even in a narrow space.

In addition to usual oblong displays, it is possible to form screens of various shapes such as the laterally longer screen, the vertically longer screen and the circular screen if the number and the arrangement of the display devices 10A to 10C of the present invention are arbitrarily changed. When the display devices 10A to 10C of the present invention are curved, a curved display can be formed.

The large screen display is used to the public in waiting rooms, lobbies, and corridors of stations, hospitals, airports, libraries, department stores, hotels, and wedding halls in the use of the features of the thin type, the large screen, and the wide angle of visibility. Further, the large screen display may be utilized for screens of cinema complexes, sing-along machine or karaoke boxes, and mini-theaters. The large screen display is available in both indoor and outdoor locations.

According to the above embodiments, the color layer such as the color filter 52 is formed at the upper portion of the light-reflective layer 50 of the picture element assembly 30 or on the surface of the display panel 20. Alternatively, the color layer may be formed on the back surface of the display panel 20. Specifically, when a plurality of the reflective display devices 10A to 10C of the first to third embodiments are arranged for an unillustrated display panel or a frame (including a lattice frame) having a large size to construct a large screen display, the color layer may be formed on the front surface or the back surface of the large-sized display panel. Alternatively, a plate or a film, which has the color layer, may be provided for the display panel 20 or a large-sized display panel. When the color layer is provided for the display panel 20 or the large-sized display panel, the color filter 52 is preferably used. In this case, as for the picture element assembly 30, it is preferable to use any one of the white scattering element, the color scattering element, and the color filter 52 as the color layer. However, it is particularly preferable to use the white scattering element.

When the voltage is supplied to the display device 10A to 10C in order to perform the display with the display device 10A to 10C according to each of the first to third embodiments, the purpose can be achieved by connecting lead wires, connectors, printed circuit boards, and flexible printed circuit boards to electrodes arranged on the back surface or near the end of the actuator substrate 32. A circuit element may be formed or a part may be mounted on the front surface or the back surface of the actuator substrate 32. For example, a wiring board on which connectors and driver IC's are mounted is connected electrically and mechanically by a conductive adhesive in opposite relation to the back surface side (side opposite to the display surface) of the actuator substrate 32.

As the preferable wiring board, it is possible to use printed circuit boards, flexible printed circuit boards, build-up boards, ceramic wiring boards or the like. The wiring board may be single-layered or multi-layered. To the electric connecting method, it is possible to apply the conductive adhesive as well as the methods based on soldering, anisotropic conductive film, conductive rubber, wire bonding, lead frame, pin, spring, and pressure-securing.

It is a matter of course that the reflective display device according to the present invention is not limited to the above embodiments, which may be embodied in other various forms without deviating from the gist or essential characteristics of the present invention.

What is claimed is:

1. A reflective display device comprising:

a display panel into which light is radiated from a light source through the front of the display panel;

a driving section disposed at the back of said display panel, said driving section including a plurality of actuator elements corresponding to a number of picture elements;

a picture element assembly provided on each of said actuator elements, said picture element assembly including at least one of a light-reflecting section and a light-absorbing section; and at least one of a light-absorptive and a light-reflective substance filled between said display panel and said driving section, wherein said actuator elements are selectively driven according to an attribute of an input image signal for controlling displacement of said picture element assembly in a direction closer to or away from said display panel, thereby adjusting the degree of at least one of light-absorption and light reflection between said display panel and said picture element assembly so that a screen image corresponding to said image signal is displayed on said display panel.

2. The reflective display device according to claim 1, wherein said display panel is transparent.

3. The reflective display device according to claim 1, wherein light emission is effected when a thickness of said light-absorptive substance between said display panel and said picture element assembly is decreased by displacing said picture element assembly in said direction closer to said display panel; and light emission is stopped when said thickness of said light-absorptive substance between said display panel and said picture element assembly is increased by displacing said picture element assembly in said direction away from said display panel.

4. The reflective display device according to claim 1, wherein light emission is stopped when a thickness of said light-reflective substance between said display panel and said picture element assembly is decreased by displacing said picture element assembly in said direction closer to said display panel; and light emission is effected when said thickness of said light-reflective substance between said display panel and said picture element assembly is increased by displacing said picture element assembly in said direction away from said display panel.

5. The reflective display device according to claim 1, wherein said picture element assembly has a color layer.

6. The reflective display device according to claim 1, wherein said display panel has a color layer.

* * * * *